US007179365B2

(12) United States Patent
Aldous et al.

(10) Patent No.: US 7,179,365 B2
(45) Date of Patent: Feb. 20, 2007

(54) PROCESS FOR PRODUCING LUBRICANT BASE OILS

(75) Inventors: Keith K. Aldous, Winchester, VA (US); Jacob B. Angelo, Spring, TX (US); Christopher J. S. Kent, Paulsboro, NJ (US); Geraldine P. Gatton, Vienna, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 386 days.

(21) Appl. No.: 10/789,564

(22) Filed: Feb. 27, 2004

(65) Prior Publication Data

US 2004/0222129 A1 Nov. 11, 2004

Related U.S. Application Data

(60) Provisional application No. 60/464,710, filed on Apr. 23, 2003.

(51) Int. Cl.

| | |
|---|---|
| ***C10G 69/02*** | (2006.01) |
| ***C10G 67/00*** | (2006.01) |
| ***C10G 65/02*** | (2006.01) |
| ***C10G 45/00*** | (2006.01) |
| ***C10G 73/02*** | (2006.01) |

(52) U.S. Cl. ..... 208/49; 208/57; 208/28

(58) Field of Classification Search ..... 208/49, 208/57, 28

See application file for complete search history.

(56) References Cited

U.S. PATENT DOCUMENTS

| | | | | | |
|---|---|---|---|---|---|
| 3,487,005 | A | * | 12/1969 | Egan et al. | 208/59 |
| 3,637,484 | A | | 1/1972 | Hansford | 208/143 |
| 3,878,115 | A | * | 4/1975 | Souillard et al. | 508/391 |
| 4,695,365 | A | | 9/1987 | Ackelson et al. | 208/89 |
| 4,699,707 | A | | 10/1987 | Moorehead et al. | 208/57 |
| 4,744,884 | A | | 5/1988 | Moorehead et al. | 208/111 |
| 4,944,862 | A | * | 7/1990 | Chen et al. | 208/49 |
| 5,246,568 | A | * | 9/1993 | Forbus et al. | 208/59 |
| 5,273,645 | A | | 12/1993 | Clark et al. | 208/87 |
| 5,770,542 | A | | 6/1998 | Brandes et al. | 502/527 |
| 5,951,848 | A | | 9/1999 | Baker, Jr. et al. | 208/28 |
| 5,976,354 | A | | 11/1999 | Powers et al. | 208/89 |
| 6,051,127 | A | | 4/2000 | Moureaux | 208/58 |

FOREIGN PATENT DOCUMENTS

FR WO 02/08363 1/2002

OTHER PUBLICATIONS

Ramaswarmy, A. V.; Samuel, Violet; Ramaswamy, Veda; Sivasanker, S., "Upgrading of paraffinic oils to low pour specialty lube stocks through catalytic processes," (National Chemical Laboratory, Pune-411 008), Adv. Prod. Appl. Lube Base Stocks, Proc. Inst. Symposium (1994), 180-7. Editor(s): Singh, Himmat: Prasada Rao, T.S.R. Publisher: Tata McGraw-Hill, New Delhi, India.

* cited by examiner

*Primary Examiner*—Glenn Caldarola
*Assistant Examiner*—John Douglas
(74) *Attorney, Agent, or Firm*—J. J. Kliebert; L. E. Carter

(57) ABSTRACT

The instant invention is an improved process for producing naphthenic base oils from low quality feedstocks.

27 Claims, No Drawings

PROCESS FOR PRODUCING LUBRICANT BASE OILS

CROSS-REFERENCE TO RELATED APPLICATION

This application claims benefit of U.S. provisional patent application Ser. No. 60/464,710 filed Apr. 23, 2003.

FIELD OF THE INVENTION

The present invention is an improved process for producing lubricant base oils. More particularly, the instant invention is an improved process for producing naphthenic base oils from low quality feedstocks.

BACKGROUND OF THE INVENTION

End-users of process oils are requesting increased solvency of these products as indicated by lower aniline point requirements. Simultaneously, the availability and supply of conventional naphthenic crude oil sources is declining. Thus, there exists a need in the art for a process that produces naphthenic base oils, particularly those base oils having a lower aniline point, from a lesser amount of naphthenic distillate.

U.S. Pat. Nos. 4,744,884, and 4,699,707, both to Moorehead, et al. disclose a process to produce lubricating oil fractions boiling above 650° F. (343.3° C.) having a pour point at or below 10° F. (−12.2° C.) and a viscosity index of at least 95. The process comprises hydrotreating a full-range shale oil and then hydrodewaxing the effluent from the hydrotreating step. The product from the hydrodewaxing step is passed to a hydrogenation reactor wherein it is contacted with a catalyst containing a hydrogenation metal component. After hydrogenating the product from the hydrogenation stage is fractionated into one or more lubricating oil fractions.

U.S. Pat. No. 5,976,354, Powers, et al. discloses a process whereby the practitioner can produce a diesel fraction, light oil fraction, and a finished oil. The process comprises the steps of mild hydrotreating, followed by catalytic dewaxing, and an optional aromatics saturation step after the catalytic dewaxing. The product from the catalytic dewaxing, or from the optional aromatics saturation step, is sent to a fractionation tower to separate the products. All of the above-cited references are hereby incorporated by reference.

There still exists a need in the art for a process that produces naphthenic base oils, particularly those base oils having a low aniline point, from a low quality feedstock.

SUMMARY OF THE INVENTION

The instant invention is a process for producing at least one naphthenic base oil having a low aniline point from a hydrocarbon feedstock containing heteroatom species and aromatics and boiling in the gas oil range, said process comprising:

a) hydrofining said feedstock under hydrofining conditions effective for removing at least a portion of the heteroatom species and saturating at least a portion of said aromatics to produce a first stage effluent having a reduced amount of heteroatom species;

b) stripping said first stage effluent to remove at least a portion of lower boiling hydrocarbons and hydrogen sulfide in a stripping column wherein at least one intermediate stream is removed from said stripping column;

c) dewaxing said intermediate stream in a catalytic dewaxing unit to produce at least one second stage effluent containing heteroatom species;

d) hydrotreating said second stage effluent under hydrotreating conditions effective for removing at least a portion of the heteroatom species to produce at least one third stage effluent having a reduced amount of heteroatom species; and e) fractionating said third stage effluent to produce at least one naphthenic base oil.

In one embodiment at least two base oils having low aniline points are produced from a hydrocarbon feedstock comprising a mixture of several refinery streams selected from coker gas oil, lube extracts, deasphalted oil, fuels distillates, and cracker resids, said hydrocarbon feedstock containing heteroatom species and aromatics and boiling in the range of about 150° C. to about 550° C.

In another embodiment at least three base oils having low aniline points are produced from a hydrocarbon feedstock comprising a mixture of several refinery streams selected from coker gas oil, lube extracts, deasphalted oil, fuels distillates, and cracker resids, said hydrocarbon feedstock containing heteroatom species and aromatics and boiling in the range of about 150° C. to about 550° C.

DETAILED DESCRIPTION OF THE INSTANT INVENTION

The present invention is a process for producing at least one naphthenic base oil from a hydrocarbon feedstock boiling in the gas oil range. By naphthenic it is meant a base oil having a viscosity index of less than 85 and wherein at least 30% of the carbon bonds of the base oil are of the naphthenic type as defined by ASTM D 2140. The feedstock is first hydrofined under effective conditions to remove or convert at least a portion of the heteroatom species that are present in the feedstock, and the hydrofining step also saturates at least a portion of the aromatics present in the feedstock. Thus, the hydrofining step produces a first stage effluent that has a reduced amount of heteroatom contaminants and saturated aromatics. After hydrofining, the first stage effluent is passed to a stripping stage to remove lighter hydrocarbon components and hydrogen sulfide through the use of a conventional stripper. The preferred stripper used has at least one reflux tray and at least one feed tray. During the stripping stage, at least one intermediate stream is removed from the stripper at a point between the reflux tray and the feed tray. The intermediate stream is catalytic dewaxed in a dewaxing stage, sometimes referred to herein as a dewaxing zone, to produce a second stage effluent, and the second stage effluent is then hydrotreated to produce at least one third stage effluent having a reduced amount of heteroatom species. The third stage effluent is subsequently passed to a fractionation zone wherein at least one naphthenic base oil is produced. It should be noted that naphthenic base oils are characterized by having an aniline point at a given viscosity lower than a more paraffinic base oil of the same viscosity.

The feedstock used in the instant process boils in the gas oil range, about 150° C. to about 550° C., and contains aromatics and undesirable heteroatom species. The feedstock can be a mixture of several less desirable refinery streams such as, for example, coker gas oil, lube extracts, deasphalted oil, fuels distillates, and cracker resids, and it is preferred that the instant process be used to treat such less desirable refinery streams.

The feedstock is first passed to a hydrofining stage, sometimes referred to herein as a first stage or zone. Hydrofining typically removes sulfur and nitrogen polar compounds and results in some saturation of aromatic compounds such as thiophene. It should be noted that some degree of cracking also occurs in the hydrofining stage. Thus, the first stage produces a first stage effluent having at least a portion of the aromatics present in the feedstock saturated, and a decreased concentration of sulfur heteroatom compounds and nitrogen heteroatom compounds. The hydrofining process can be carried out by contacting the feedstock with a catalytically effective amount of a hydrofining catalyst in the presence of hydrogen under suitable hydrofining conditions. The hydrofining process can be carried out using any suitable reactor configuration. Non-limiting examples of suitable reactor configurations include a fixed catalyst bed, fluidized catalyst bed, moving bed, slurry bed, counter current, and transfer flow catalyst bed. A fixed catalyst bed is preferred.

The catalyst used in the hydrofining stage to remove sulfur, and nitrogen typically comprises a hydrogenation metal on a suitable catalyst support. The support may be a refractory metal oxide, for example, alumina, silica or silica-alumina. The hydrogenation metal comprises at least one metal selected from Group 6 and Groups 8–10 of the Periodic Table (based on the IUPAC Periodic Table format having Groups from 1 to 18). The metal will generally be present in the catalyst composition in the form of an oxide or sulfide. Particularly suitable metals are iron, cobalt, nickel, tungsten, molybdenum, chromium and platinum. Cobalt, nickel, molybdenum and tungsten are the more preferred. A particularly preferred catalyst composition is $Al_2O_3$ promoted by CoO or NiO and $MoO_3$.

Any suitable effective reaction time between the catalyst composition and the feedstock may be utilized. In general, the effective reaction time will range from about 0.1 hours to about 10 hours. Preferably, the reaction time will range from about 0.3 to about 5 hours. This typically requires a liquid hourly space velocity (LHSV) in the range of about 0.10 to about 10 cc of oil per cc of catalyst per hour, preferably from about 0.2 to about 3.0 cc/cc/hr.

The temperature in the first stage will typically be in the range of about 150° C. to about 450° C., preferably about 300 to about 375° C. As previously stated, the first stage is effectuated in the presence of hydrogen. Any suitable hydrogen pressure may be utilized in the hydrofining stage. The reaction pressure will generally be in the range of about atmospheric to about 10,000 psig (68,950 kPa). Preferably, the pressure will be in the range of about 500 to about 3,000 psig (3548 to 20651 kPa), more preferably about 1000 to about 2000 psig (6996 to 13891 kPa). The quantity of hydrogen used to contact the feed stock will generally be in the range of about 100 to about 10,000 standard cubic feet per barrel of the feed stream (17.8 to 1780 $m^3/m^3$), preferably about 300 to about 5,000 standard cubic feet per barrel (53.4 to 890.5 $m^3/m^3$), more preferably 500 to about 3500 standard cubic feet per barrel (89.1 to 623.4 $m^3/m^3$).

As previously stated, the hydrofining stage, removes at least a portion of the sulfur heteroatoms and nitrogen heteroatom compounds present in the feedstock. By at least a portion, it is meant that the at least about 50 vol. % of the sulfur heteroatom compounds are removed, preferably more than about 75 vol. %, more preferably more than about 90 vol. %. Typically, more than about 20 vol. % of the nitrogen heteroatom compounds are removed, preferably more than about 30 vol. %, and more preferably about 40 vol. %. The hydrofining stage also results in the saturation of at least a portion of the aromatics present in the feedstock. By at least a portion it is meant that less than about 20 vol. % of the aromatics present in the feedstock are saturated, preferably less than 15 vol. %, more preferably less than 10 vol. %, and most preferably about 5 to about 10 vol. % of the aromatics are saturated.

After exiting the hydrofining stage, the first stage effluent is stripped to remove at least a portion of any light hydrocarbon components and at least a portion of any hydrogen sulfide present. The stripping column used in stripping the first stage effluent can be any stripping column known in the art suitable for the above-mentioned purpose. It is preferred that the stripper used possesses a reflux tray and a feed tray. The stripping medium or manner of contacting the first stage effluent with the stripping medium is not critical to the instant invention and may be any medium or contacting manner known to be effective in stripping operations. During the stripping operation, an intermediate stream is removed from the stripper. The intermediate stream is removed from the separator at a location wherein the intermediate stream has an API gravity (60/60° F.) of about 15 to about 30, preferably about 20 to about 30, and more preferably about 22 to about 27. The intermediate stream is further characterized by a viscosity of about 5 to about 20 cSt at 40° F., preferably 10 to about 20, and more preferably about 10 to about 15, and a viscosity index ("VI") of about −25 to about 5, preferably −20 to about 0, and more preferably −20 to about −5. The intermediate stream has a 5% LV, as determined by ASTM D6417, of about 350 to about 450° F., preferably about 350 to about 425° F., more preferably about 380 to about 405° F., and a 95% LV, as determined by ASTM D6417, of about 700 to about 1250° F., preferably about 800 to about 1200° F., more preferably about 800 to about 1000° F. The intermediate stream also contains less than about 500 wppm sulfur, preferably less than about 400 wppm, more preferably less than about 300 wppm. The intermediate stream is further characterized as having an aniline point of less than about 200° F., preferably about 100 to about 200° F., more preferably about 125 to about 200° F., and most preferably about 130 to about 160° F. In the preferred embodiment, the intermediate stream is removed from the stripper at a point between the reflux tray and the feed tray.

As previously stated, the intermediate stream is passed to a catalytic dewaxing stage, sometimes referred to herein as the second stage or zone, wherein at least one second stage effluent is produced. The dewaxing catalyst may be either crystalline or amorphous. The crystalline materials used herein are preferably molecular sieves that contain at least one 10 or 12 ring channel and may be based on aluminosilicates (zeolites) or on silicoaluminophosphates (SAPOs). Non-limiting examples of suitable zeolites include ZSM-22, ZSM-23, ZSM-35, ZSM-48, ZSM-57, ferrierite, ITQ-13, MCM-68 and MCM-71. Non-limiting examples of aluminophosphates containing at least one 10-ring channel include ECR-42. Non-limiting examples of molecular sieves containing 12 ring channels include zeolite beta, and MCM-68. The molecular sieves are described in U.S. Pat. Nos. 5,246,566, 5,282,958, 4,975,177, 4,397,827, 4,585,747, 5,075,269 and 4,440,871. MCM-68 is described in U.S. Pat. No. 6,310,265. MCM-71 and ITQ-13 are described in PCT published applications WO 0242207 and WO 0078677, all of which are incorporated herein by reference. ECR-42 is disclosed in U.S. Pat. No. 6,303,534, which is also incorporated herein by reference. Preferred catalysts include ZSM-48, ZSM-22 and ZSM-23. Especially preferred is ZSM-48. The molecular sieves are preferably in the hydrogen form. Reduction can occur in situ during the dewaxing step itself or can occur ex situ in another vessel. Further, the dewaxing catalyst may be used in sulfided or unsulfided form, and is preferably in the sulfided form.

Amorphous dewaxing catalysts include alumina, fluorided alumina, silica-alumina, fluorided silica-alumina and silica-alumina doped with Group 3 metals. Such catalysts are described in, for example, U.S. Pat. Nos. 4,900,707 and 6,383,366, both of which are incorporated herein by reference.

The dewaxing catalysts used are bifunctional. By bifunctional it is meant that the dewaxing catalysts have a dewaxing function and a hydrogenation function. The hydrogenation function is preferably provided by at least one Group 6 metal, at least one Group 8–10 metal, or mixtures thereof. Preferred metals are Groups 9–10 metals. Especially preferred are Groups 9–10 noble metals such as Pt, Pd or mixtures thereof (based on the IUPAC Periodic Table format having Groups from 1 to 18). These metals are present in an amount ranging from about 0.1 to 30 wt. %, preferably about 0.1 to about 10 wt. %, more preferably about 0.1 to about 5 wt. %, based on the total weight of the catalyst. Catalyst preparation and metal loading methods are described for example in U.S. Pat. No. 6,294,077, which is incorporated herein by reference, and include, for example, ion exchange and impregnation using decomposable metal salts. Metal dispersion techniques and catalyst particle size control are described in U.S. Pat. No. 5,282,958, which is also incorporated herein by reference. Catalysts with small particle size and well-dispersed metals are preferred.

The molecular sieves are typically composited with binder materials which are usually refractory materials that are resistant to high temperatures which may be employed under dewaxing conditions to form a finished dewaxing catalyst or may be binderless (self bound or bulk). The binder materials are typically selected from inorganic oxides such as silica, alumina, silica-aluminas, binary combinations of silicas with other metal oxides such as titania, magnesia, thoria, zirconia and the like and tertiary combinations of these oxides such as silica-alumina-thoria and silica-alumina magnesia. The amount of molecular sieve in the finished dewaxing catalyst is typically from about 10 to about 100 wt. %, preferably about 35 to about 100 wt. %, based on the total weight of the catalyst. Such catalysts are formed by methods such as, for example, spray drying, extrusion and the like.

Dewaxing conditions typically include temperatures of from about 250–400° C., preferably about 275 to 350° C., pressures of from about 791 to about 20786 kPa (100 to 3000 psig), preferably about 1480 to about 17339 kPa (200 to 2500 psig). Typically, liquid hourly space velocities range from about 0.1 to about 10 $hr^{-1}$, preferably about 0.1 to about 5 $hr^{-1}$, and hydrogen treat gas rates range from about 45 to about 1780 $m^3/m^3$ (250 to 10000 scf/B), preferably about 89 to 890 about $m^3/m^3$ (500 to 5000 scf/B).

The at least one second stage effluent exiting the dewaxing stage is passed to a hydrotreating stage, sometimes referred to herein as the third zone or stage. In some instances, it may be preferred to utilize a cooling stage between the dewaxing stage. The cooling stage allows the practitioner to operate the dewaxing stage at high temperatures. Interstage cooling can be effectuated through the use of any means known to effectively lower the temperature of a process stream. Non-limiting examples include direct and indirect heat exchangers.

The term "hydrotreating" as used herein refers to processes wherein a hydrogen-containing treat gas is used in the presence of a suitable hydrotreating catalyst that is primarily active for the removal of heteroatoms, such as sulfur, and nitrogen. Suitable hydrotreating catalysts for use in the present invention are any conventional hydrotreating catalyst and includes those which are comprised of at least one Group 8–10 metal, preferably Fe, Co and Ni, more preferably Co and/or Ni, and most preferably Co; and at least one Group 6 or 16 metal, preferably Mo and W, more preferably Mo, on a high surface area support material, preferably alumina. It is within the scope of the present invention that more than one type of hydrotreating catalyst be used in the same reaction vessel. The Group 8–10 metal is typically present in an amount ranging from about 2 to 20 wt. %, preferably from about 4 to 12%. The Group 6 or 16 metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group 8–10 metal would mean that 20 g. of Group 8–10 metal was on the support. Typical hydrotreating temperatures range from about 100° C. to about 400° C. with pressures from about 50 psig to about 3,000 psig, preferably from about 50 psig to about 2,500 psig.

The hydrotreating of the second stage effluent produces at least one third stage effluent having a reduced amount of heteroatom species. The third stage effluent may be passed directly to a fractionation tower or it may be stripped to remove hydrogen sulfide and lighter hydrocarbon components such as light fuel oil, etc. It is preferred that the third stage effluent also be stripped. The stripping column used in stripping the third stage effluent can be any stripping column known. The stripping medium or manner of contacting the stripping medium with the third stage effluent is not critical to the instant invention and may be any medium or contacting manner known to be effective in stripping operations.

The third stage effluent is passed to a fractionating stage to produce at least one naphthenic base oil having a low aniline point. By low aniline point, it is meant that the at least one naphthenic base oil has an aniline point lower than about 250° F., preferably about 100 to about 250° F., more preferably about 100 to about 200° F., more preferably about 100 to about 180° F. The fractionating stage employs a fractionation tower that can be an atmospheric fractionation tower or a vacuum fractionation tower. Preferably the fractionation tower is a vacuum fractionation unit. The at least one naphthenic base oil produced by fractionating the third stage effluent typically has a viscosity of about 60 SSU at 100° F. to about 2000 SSU at 100° F. Preferably there are at least two naphthenic base oils produced by fractionating the third stage effluent. The first naphthenic base oil has a viscosity of about 100 to about 750 SSU at 100° F., and the second naphthenic base oil has a viscosity greater than about 750 SSU at 100° F. More preferably there are at least three naphthenic base oils produced by fractionating the third stage effluent. The first of the three naphthenic base oils has a viscosity of about 100 SSU to about 150 SSU at 100° F., preferably about 100 to about 125 SSU at 100° F. The second of the three naphthenic base oils has a viscosity of about 700 to about 800 SSU at 100° F., preferably 725 to about 775 SSU at 100° F. The third of the three naphthenic base oils has a viscosity of about 1100 to about 1300 SSU at 100° F., preferably 1150 to about 1250 SSU at 100° F. The fractionation of the third stage effluent also typically results in the production of a bottoms fraction having a viscosity and boiling point greater than any of the naphthenic base oil produced, and a lighter fraction typically boiling in the kerosene range.

The base oils produced by the instant invention can be used as blend components to replace lube products in the desired viscosity range. The above description is directed at preferred embodiments of the present invention and it is not intended to limit the invention thereto. One having ordinary skill in the art will recognize that there are modifications and variations that are still within the spirit and scope of the present invention. The inventors herein contemplate any such variations and modifications and contemplate to cover such variations and modifications within the true spirit and scope of the present invention with the attached claims.

The invention claimed is:

1. A process to produce at least one naphthenic base oil having a low aniline point from a hydrocarbon feedstock containing heteroatom species and aromatics and boiling in the gas oil range, said process comprising:

a) hydrofining said feedstock under hydrofining conditions effective for removing at least a portion of the heteroatom species and saturating at least a portion of said aromatics to produce a first stage effluent having a reduced amount of heteroatom species;

b) stripping said first stage effluent in a stripping column wherein at least one intermediate stream is removed from said stripping column, wherein said intermediate stream has a viscosity index of about −25 to about 5 and an aniline point of less than 200° F.;

c) dewaxing said intermediate steam under catalytic dewaxing conditions to produce at least one second stage effluent containing heteroatom species;

d) hydrotreating said second stage effluent under hydrotreating conditions effective for removing at least a portion of the heteroatom species to produce at least one third stage effluent having a reduced amount of heteroatom species; and e) fractionating said third stage effluent to produce at least one naphthenic base oil having a VI less than 85.

2. The process according to claim 1 wherein said feedstock is a mixture of several less desirable refinery streams including coker gas oil, lube extracts, deasphalted oil, fuels distillates, and cracker resids.

3. The process according to claim 2 wherein said catalytic dewaxing conditions include temperatures from about 250–400° C., pressures of from about 791 to about 20786 kPa (100 to 3000 psig), liquid hourly space velocities ranging from about 0.1 to about 10 $hr^{-1}$, and hydrogen treat gas rates range from about 45 to about 1780 $m^3/m^3$ (250 to 10000 scf/B).

4. The process according to claim 3 wherein catalysts used in dewaxing said intermediate stream are selected from 10 or 12 ring zeolites and silicoaluminophosphates.

5. The process according to claim 3 wherein said hydrotreating conditions include temperatures from about 100° C. to about 400° C. and pressures from about 50 psig to about 3,000 psig.

6. The process according to claim 5 wherein catalysts used in hydrotreating said second stage effluent are selected from conventional hydrotreating catalysts comprising about 2 to 20 wt % of at least one metal selected from Group 8–10 metals, and about 5 to 50 wt % of at least one Group 6 or 16 metal on a high surface area support material.

7. The process according to claim 6 wherein said intermediate stream has an API gravity (60/60° F.) of about 15 to about 30) a viscosity of about 5 to about 20 cSt at 40° F., a viscosity index ("VI") of about −25 to about 5, a 5% LV of about 350 to about 450° F., and a 95% LV of about 700 about 1250° F.

8. The process according to claim 7 wherein said intermediate stream is further characterized as having less than about 500 wppm sulfur, and an aniline point of less than about 200° F.

9. The process according to claim 6 wherein said intermediate steam has an API gravity (60/60° F.) of about 20 to about 30, a viscosity of about 10 to about 20 at 40° F., a viscosity index ("VI") of about −20 to about 0, a 5% LV of about 350 to about 425° F., and a 95% LV of about 800 to about 1200° F.

10. The process according to claim 7 wherein said intermediate stream is further characterized as having less than about 400 wppm sulfur, and an aniline point of about 125 to about 200° F.

11. The process according to claim 6 wherein said intermediate stream API gravity (60/60° F.) of about 22 to about 27, a viscosity of about 10 to about 15 at 40° F., a viscosity index ("VI") of about −20 to about −5, a 5% LV of about 380 to about 405° F., and a 95% LV of about 800 to about 1000° F.

12. The process according to claim 7 wherein said intermediate stream is further characterized as having less than about 300 wppm sulfur, and an aniline point of about 130 to about 160° F.

13. The process according to claim 9 wherein fractionating said third stage effluent to produces at least two base oils.

14. The process according to claim 11 wherein fractionating said third stage effluent to produces at least three base oils, a fraction boiling higher than any of said three base oils and a fraction boiling in the kerosene range.

15. The process according to claim 2 wherein said at least one base oil has a viscosity of about 60 SSU to about 2000 SSU at 100° F.

16. The process according to claim 13 wherein the first of said at least two base oils has a viscosity of about 100 SSU to about 750 SSU at 100° F., and the second of said at least two base oils has a viscosity greater than about 750 SSU at 100° F.

17. The process according to claim 14 wherein the first of said at least three base oils has a viscosity of about 100 SSU to about 150 SSU at 100° F.; the second of said at least two base oils has a viscosity of greater than about 700 SSU to about 800 SSU at 100° F., and the third of said at least three base oils has a viscosity of about 1100 SSU to about 1300 SSU at 100° F.

18. A process for producing at least two naphthenic base oils having low aniline points from a hydrocarbon feedstock comprising at least one refinery stream selected from coker gas oil, lube extracts, deasphalted oil, fuel distillates, and cracker resids, said hydrocarbon feedstock containing heteroatom species and aromatics and boiling in the range of about 150° C. to about 550° C., said process comprising:

a) hydrofining said feedatock under hydrofining conditions effective for removing at least about 50 vol. % of the sulfur heteroatom compounds, more than about 20 vol. % of the nitrogen heteroatom compounds, and saturating about 20 vol. % of the aromatics present in the feedstock are saturated to produce a first stage effluent having a reduced amount of heteroatom species;

b) stripping said first stage effluent in a stripping column having at least one feed tray and at least one reflux tray wherein at least one intermediate stream characterized as having less than about 500 wppm sulfur, an aniline point of about 100 to about 200° F., an API gravity (60/60° F.) of about 15 to about 30, a viscosity of about 5 to about 20 cSt at 40° F., a viscosity index ("VI") of about −25 to about 5, a 5% LV of about 350 to 450° F., and a 95% LV of about 700 to about 1250° F. is removed from said stripping column at a point between said feed tray and said reflux tray;

c) dewaxing said intermediate stream under catalytic dewaxing conditions to produce at least one second stage effluent containing heteroatom species;

d) hydrotreating said second stage effluent under hydrotreating conditions effective for removing at least a portion of the heteroatom species to produce at least one third stage effluent having a reduced amount of heteroatom species; and e) fractionating said third stage effluent to produce at least two naphthenic base oils having a VI less than 85 wherein the first of said at least two base oils has a viscosity of about 100 SSU to 750 SSU at 100° F. and the second of said at least two base oils has a viscosity greater than about 750 SSU at 100° F.

19. The process according to claim 18 wherein said catalytic dewaxing is carried out by contacting said intermediate stream with a dewaxing catalyst selected from 10 or 12 ring zeolites and silicoaluminophosphates under conditions including temperatures from about 250–400° C., pressures of from about 791 to about 20786 kPa (100 to 3000 psig), liquid hourly space velocities ranging from about 0.1 to about 10 $hr^{-1}$, and hydrogen treat gas rates range from about 45 to about 1780 $m^3/m^3$ (250 to 10000 scf/B).

20. The process according to claim 18 wherein said hydrotreating is carried out by contacting said second stage effluent with a hydrotreating catalyst selected from conventional hydrotreating catalysts comprising about 2 to 20 wt. % of at least one metal selected from Group 8–10 metals, and about 5 to 50 wt. % of at least one Group 6 or 16 metal on a high surface area support material under conditions including temperatures from about 100° C. to about 400° C. and pressures from about 50 psig to about 3,000 psig.

21. The process according to claim 19 wherein said intermediate stream has less than about 400 wppm sulfur, an API gravity (60/60° F.) of about 20 to about 30, a viscosity of about 10 to about 20 at 40° F., a viscosity index ("VI") of about −20 to about 0, a 5% LV of about 350 to 425° F., a 95% LV of about 800 to about 1200° F., and an aniline point of about 125 to about 200° F.

22. The process according to claim 19 wherein said intermediate stream has less than about 300 wppm sulfur, an API gravity (60/60° F.) of about 22 to about 27, a viscosity of about 10 to about 15 at 40° F., a viscosity index ("VI") of about −20 to about −5, a 5% LV of about 380 to about 405° F., a 95% LV of about 800 to about 1000° F., and an aniline point of about 130 to about 160° F.

23. The process according to claim 21 wherein fractionating said third stage effluent to produces at least three base oils, a fraction boiling higher than any of said three base oils and a fraction boiling in the kerosene range.

24. The process according to claim 22 wherein the first of said at least three base oils has a viscosity of about 100 SSU to 150 SSU at about 100° F; the second of said at least two base oils has a viscosity of greater than about 700 SSU to about 800 SSU at 100° F., and the third of said at least three base oils has a viscosity of about 1100 SSU to about 1300 SSU at 100° F.

25. A process for producing at least three naphthenic base oils having low aniline points from a feedstock comprising at least one refinery stream selected from coker gas oil, lube extracts, deasphalted oil, fuels distillates, and cracker resids, said hydrocarbon feedstock containing heteroatom species and aromatics and boiling in the range of about 150° C. to about 550° C., said process comprising:

a) hydrofining said feedstock under hydrofining conditions effective for removing at least about 50 vol. % of the sulfur heteroatom compounds, more than about 20 vol. % of the nitrogen heteroatom compounds, and saturating about 20 vol. % of the aromatics present in the feedstock are saturated to produce a first stage effluent having a reduced amount of heteroatom species;

b) stripping said first stage effluent in a stripping column having at least one feed fray and at least one reflux tray wherein at least one intermediate stream characterized as having less than about 400 wppm sulfur, an API gravity (60/60° F.) of about 20 to about 30, a viscosity of about 10 to about 20 at 40° F., a viscosity index ("VI") of about −20 to about 0, a 5% LV of about 350 to about 425° F., a 95% LV of about 800 to about 1200° F., and an aniline point of about 125 to about 200° F. is removed from said stripping column at a point between said feed tray and said reflux tray;

c) dewaxing said intermediate stream under catalytic dewaxing conditions to produce at least one second stage effluent containing heteroatom species;

d) hydrotreating said second stage effluent under hydrotreating conditions effective for removing at least a portion of the heteroatom species to produce at least one third stage effluent having a reduced amount of heteroatom species; and e) fractionating said third stage effluent to produce at three naphthenic base oils having a VI less than 85, a fraction boiling higher than any of said three base oils, and a fraction boiling in the kerosene range, wherein the first of said at least three base oils has a viscosity of about 100 SSU to about 150 SSU at 100° F.; the second of said at least two base oils has a viscosity of greater than about 700 SSU to about 800 SSU at 100° F., and the third of said at least three base oils has a viscosity of about 1100 SSU to about 1300 SSU at 100° F.

26. The process according to claim 25 wherein said catalytic dewaxing is carried out by contacting said intermediate stream with a dewaxing catalyst selected from 10 or 12 ring zeolites and silicoaluminophosphates under conditions including temperatures from about 250–400° C., pressures of from about 791 to about 20786 kPa (100 to 3000 psig), liquid hourly space velocities ranging from about 0.1 to about 10 $hr^{-1}$, and hydrogen treat gas rates range from about 45 to about 1780 $m^3/m^3$ (250 to 10000 scf/B).

27. The process according to claim 26 wherein said hydrotreating is carried out by contacting said second stage effluent with a hydrotreating catalyst selected from conventional hydrotreating catalysts comprising about 2 to 20 wt. % of at least one metal selected from Group 8–10 metals, and about 5 to 50 wt. % of at least one Group 6 or 16 metal on a high surface area support material under conditions including temperatures from about 100° C. about 400° C. and pressures from about 50 psig to about 3,000 psig.

* * * * *